United States Patent [19]

Schultz

[11] Patent Number: 4,710,236

[45] Date of Patent: Dec. 1, 1987

[54] METHOD FOR THE PREPARATION OF A METALLIC BODY FROM AN AMORPHOUS ALLOY

[75] Inventor: Ludwig Schultz, Bubenreuth, Fed. Rep. of Germany

[73] Assignee: Siemens Aktiengesellschaft, Munich, Fed. Rep. of Germany

[21] Appl. No.: 848,984

[22] Filed: Apr. 7, 1986

[30] Foreign Application Priority Data

Apr. 26, 1985 [DE] Fed. Rep. of Germany ..... 3515167

[51] Int. Cl.[4] ..... C22C 1/00

[52] U.S. Cl. ..... 148/11.5 P; 148/13; 148/13.1; 420/129; 420/590; 419/33

[58] Field of Search ..... 148/403, 13, 13.1, 14, 148/15, 126, 11.5 P; 420/590; 75/0.5 R, 0.5 B, 0.5 BA, 129; 419/33, 38

[56] References Cited

U.S. PATENT DOCUMENTS

| | | | |
|---|---|---|---|
| 4,439,236 | 3/1984 | Ray | 75/123 B |
| 4,443,249 | 4/1984 | Weber et al. | 75/0.5 R |

FOREIGN PATENT DOCUMENTS

| | | |
|---|---|---|
| 2926 | 8/1984 | European Pat. Off. . |
| 2834425 | 2/1979 | Fed. Rep. of Germany . |
| 3128063 | 5/1982 | Fed. Rep. of Germany . |
| 3135374 | 9/1982 | Fed. Rep. of Germany . |
| 84/002926 | 8/1984 | PCT Int'l Appl. . |

OTHER PUBLICATIONS

Benjamin, J. S., "Mechanical Alloying", Scientific American, vol. 234, 1976, pp. 40–48.

Applied Physics Letters, "Preparation of Amorphous $Ni_{60}Nb_{40}$ by Mechanical Alloying", by Koch et al., vol. 43, No. 11, Dec. 1, 1983, pp. 1017–1020.

Machine Design, "New Method for Making Amorphous Metals," vol. 55, No. 5, Oct. 10, 1983, p. 8.

Zeitschrift für Metallkunde, "Aufbau und Eigenschaften Metallischer Gläser," Warlimont, Bd 69, 1978, pp. 212–220.

Elektrotechnik und Maschinenbau, "Glasartige Metalle," by Haferl et al., vol. 97, Sep. 1980, pp. 378–385.

Physical Review Letters, "Formation of an Amorphous Alloy by Solid State Reaction of the Pure Polycrystalline Metals", by Schwartz et al., vol. 51, No. 5, Aug. 83, pp. 415–418.

Journal of Non-Crystalline Solids, "Amorphorous Zr-Ni Film Formed by Solid State Reactions," by Clemens et al., vol. 61 and 62, 1984, pp. 817–822.

Proc. MRS Europe Meeting on Amorphous Metals and Non-Equilibrium Processing," L. Schultz, 1984, pp. 135–140.

Journal of Nuclear Materials, "Solute Diffusion in Dilute Alloys", by LeClaire, vol. 69 & 70, 1978, pp. 70–96.

Applied Physics Letters, "High Energy Product Nd--Fe-B Permanet Magnets", by Croat, vol. 44(1), Jan. 1, 1984, pp. 148–149.

*Primary Examiner*—Christopher W. Brody

*Attorney, Agent, or Firm*—Kenyon & Kenyon

[57] ABSTRACT

An amorphous metal body is produced from an intermediate product formed by compacting at least two usually crystalline components of the alloy in powder form. The alloying components in the intermediate product extend in at least one dimension at most 1 um. The intermediate product is converted into the amorphous metallic body by means of a diffusion reaction at a predetermined elevated temperature. In order to produce bodies of larger size on a large technical scale, a mixture powder comprising particles is produced from the alloying components in powder form by a milling process which is terminated at a predetermined time in such a manner that the particles produced by milling have at least a predominantly layer-like structure of the alloying components. This mixture powder is then compacted into the intermediate product with the desired shape and dimensions. The intermediate product is optionally deformed.

22 Claims, No Drawings

METHOD FOR THE PREPARATION OF A METALLIC BODY FROM AN AMORPHOUS ALLOY

FIELD OF THE INVENTION

This invention relates to a method for the preparation of an amorphous metal or metallic glass body wherein an intermediate product comprising at least two components of the alloy in powder form is made by performing a compacting step in such a way that the alloying components in the intermediate product extend in at least one dimension at most 1 μm. The intermediate product is converted into the amorphous metal alloy body by means of a diffusion reaction at a predetermined elevated temperature.

BACKGROUND OF THE INVENTION

Such a method is discussed, for example, in *Frankfurter Zeituno: View of the Economy,* publisher Frankfurter Allgemeine Zeitung, Vol. 27, No. 23, Feb. 1, 1984, page 5 or in *Machine Design,* Vol. 55, No. 25, Oct. 10, 1983, page 8.

Amorphous metals or metallic glasses are generally known. See, for instance, *Zeitschrift Fuer Metallkunde,* Vol. 69, 1978, No. 4, pages 212 to 220 or *Elektrotechnik und Maschinenbau,* Vol. 97, September 1980, No. 9, pages 378 to 385. In general, these materials are special alloys which can be produced by means of special processes from at least two predetermined starting elements or compounds called alloying components. These special alloys have a glasslike amorphous structure instead of a crystalline structure. Amorphous metal alloys have a number of extraordinary properties or property combinations such as high wear and corrosion resistance, high hardness and tensile strength and at the same time have high ductility as well as special magnetic properties. Furthermore, microcrystalline materials with interesting properties can be prepared via the detour of the amorphous state. See, for instance, German Pat. No. 28 34 425.

To date, metallic glasses have been prepared by rapid quenching from the molten state. See also DE-OS No. 31 35 374 or No. 31 28 063. This method, however, leads to the situation that at least one dimension of the material produced is smaller than about 0.1 mm. However, it would be desirable for various applications if metallic glasses were available in any shapes and dimensions whatever.

It has further been proposed to produce metallic glasses by a special solid-state reaction instead of by rapid quenching. In the solid-state reaction, one of the alloy components must diffuse quickly into the other below the crystallization temperature of the metallic glass to be produced, while the other component remains practically immovable. Such a diffusion reaction is generally referred to as an anomalous rapid diffusion. Certain energy-wise conditions must be met. See, for example, *Physical Review Letters,* Vol. 51, No. 5, August 1983, pages 415 to 418, or *Journal of NonCrystalline Solids,* Vols. 61 and 62, 1984, pages 817 to 822. Thus, the alloy components must react with each other exothermally. Furthermore, a definite microstructure is required because the participating alloy components are closely adjacent and have, at least in one dimension, very small dimensions extending less than 1 μm. Accordingly, layered structures are especially suitable which can be produced, for instance, by vapor deposition. See, for instance, the previously cited literature references from *Phys. Rev. Letters,* Vol. 51. The stacking of thin metal foils is also possible for this purpose. See, for instance, *Proc. MRS Europe Meeting* on *Amorphous Metals and Non-Equilibrium Processing,* publisher M. P. von Allen, Strasbourg, 1984, pages 135 to 140. In addition, a similar stratified structure can also be obtained by the method which is discussed in the publication *View of the Economy,* herebefore cited. According to this method, suitable metal powders of the desired composition are first mixed as alloy components and are then compacted to form an intermediate product. This intermediate product, in which the alloy components have a size of at most 1 μm in at least one dimension, is subsequently converted into the desired metallic body with an amorphous structure by anomalous rapid diffusion at a predetermined elevated temperature.

Whereas with the vapor deposition method, only very thin structures can be obtained, the two deformation methods mentioned assume a high ductility of the participating alloy components. In addition, difficulties arise with the prior art method when alloy components are in the powder form at the start. Oxide layers on the surface of the metal powders must be removed by the deformation and the structure resulting from the compacting and deformation is very irregular. If one considers, in addition, alloys of technical interest, it is found that frequently one of the alloy components is practically undeformable such as boron in FeNiB or cobalt in CoZr. Furthermore, some components are not obtainable in foil form or only at a high price such as the rare earth metals used for amorphous transition metal/rare earth compounds.

OBJECTS OF THE INVENTION

It is an object of the present invention to improve the method of manufacturing amorphous metal bodies from a compacted powder intermediate product using a diffusion reaction wherein amorphous metal bodies of relatively large shapes and dimensions can be manufactured on a large technical scale. It is a further objection of the present invention to permit the use of difficult to deform or brittle alloy components in such a method.

These and other objects of the present invention will become apparent from the following description and claims.

SUMMARY OF THE INVENTION

In the method according to the present invention, a mixture powder is first prepared by means of a milling process known per se, from the usually crystalline powders of the starting elements or compounds representing the alloy components. The individual particles are built up from the starting elements or compounds in layer-fashion. The time for terminating the milling process, that is the time at which this layer type structure of the particles of the mixture powder is present, can be determined and thereby fixed without difficulty, for instance, by experimental examination of the particles. The mixture powder produced in this manner is then compacted and/or deformed in a further operation to form a compact intermediate product with a shape and dimension adapted to the desired body. This compact intermediate product still comprises crystalline parts of the starting elements or compounds. The dimensions of the starting elements or compounds in the compact intermediate product are less than 1 μm in at least one dimension. In a subsequent diffusion anneal, the intermediate product is converted in a manner known per se into the desired amorphous metallic body. Since in compacting the mixture powder, there is practically no limitation regarding the extent or shape of the intermediate product that can be produced therefrom, a particular advantage of the method according to the invention is that amorphous metallic bodies can be produced with larger dimensions in a relatively simple manner on a large technical scale.

DETAILED DESCRIPTION

The method of the present invention will be described in detail with reference to the manufacture of a metallic glass body. The alloying components in powder form need not be absolutely metallic but can also be in part metalloids. In general, these components will be crystalline. In special cases, however, amorphous powders can also be employed if metalloids are used.

The metallic glass body to be manufactured may have an average composition $A_xB_y$, where A, B are e.g., the metallic starting elements or alloy components, and x, y represent atom percent (with $x+y=100$). First, powders of the two alloy components A and B are placed, together with hardened steel balls, in a suitable milling cup which is enclosed with a protective gas such as argon. The powders may have any desired size; however, a similar size distribution of the two participating components is advantageous. The resulting atomic concentration of the body to be manufactured from this powder is determined by the mass ratio of the two types of powder being employed. During the subsequent milling operation in the powder mill, the powders are pressed flat, welded together and also divided again. Advantageously, a predetermined temperature level below the crystallization temperature of the amorphous material to be formed should be maintained during the milling. Optionally, several temperature steps can be provided and a corresponding temperature program may be used. With advancing milling time, larger powder particles are generated which have, at least predominantly, a layer-like structure. That is, the larger powder particles will have a multiplicity of alternating layer-like zones of the participating alloy components. This involves a microstructure such as is also produced, for example, in the starting phase of a known method for mechanical alloying. See, for instance, *Scientific American,* Vol. 234, 1976, pages 40 to 48. Using this known method, amorphous alloys basically can also be produced. See, for instance, *Applied Physics Letters,* Vol. 43, No. 11, Dec. 1, 1983, pages 1017 to 1019.

However, in this known method of mechanical alloying, the milling is continued until the above-mentioned stratified structure is dissolved again and a true alloy is produced. In the method according to the invention, the milling operation is stopped upon reaching the layer-like structure wherein the layer-like regions are generally from about 0.01 to 0.9 μm thick and preferably between 0.05 and 0.5 μm thick. The sides of the powder particles themselves adjust themselves here to about 10 to 200 μm and preferably 20 to 100 μm in diameter. The predetermined time at which this desired structure of the powder particles is present can be determined, for instance, by a sectional examination of the particles. At the end of the milling process which must be broken off at this point in time, a mixture powder is present. The particles of the mixture powder comprise alternating thin crystalline stratified zones and therefore still have sufficient ductility for subsequent compacting at sufficiently low temperatures below the respective crystallization temperature. This mixture powder is then compacted, for example, by hammering in a jacket or extruding in an extrusion press without substantial heating. At the end of an optionally still further shaping or deformation step, an intermediate product of the body to be produced with the desired shape and dimensions is present.

A heat treatment follows wherein interdiffusion takes place as a solid state reaction and is responsible for the amorphisizing of the participating alloy components. This reaction may proceed as an anamolous, rapid diffusion in a manner known per se wherein one alloy component diffuses into the others. Other diffusion reactions, for example, mutual diffusion of the components into each other are also possible. With all these reactions it should be noted that, the finer the structure, the lower the temperatures or the shorter the annealing times which are sufficient for the complete conversion of the intermediate product into the desired body. For this solid-state diffusion reaction, it is well known that the annealing temperature must in any case be below the crystallization temperature of the metallic glass. The metallic body present as the final product at the end of this process comprises an amorphous alloy with a thickness and shape which is determined by the compacting process and can therefore be largely chosen at will.

As an alternative to the method described, the compacting and the diffusion treatment can also take place in one step, for instance, during hot extrusion. In this embodiment, care should be taken that the powder is heated only immediately before the deformation because otherwise, the amorphous phase would already be formed before the extrusion and good compacting would thereby be impeded.

The method according to the invention can be used for producing an amorphous alloy in all systems in which the amorphous phase can be produced by a solid-state reaction. The corresponding systems are generally characterized by the occurrence of anamolous fast diffusion. Corresponding element combinations as the alloying component of the systems are known. See, for instance, *Journal of Nuclear Materials,* Vols. 69 and 70, 1978, pages 70 to 96. In particular, the following are examples of alloying components:

Ni, Co, Fe, Cu, Ag, or Au in Ti, Zr, Hf, Nb, Y, La, Ta, Pb, Sn or Ge as well as in lanthanides or actinides.

B, C, P, Si in Fe, Ni, Co.

Besides these element combinations, one or both alloy components can themselves comprise an alloy or compound of several elements. B in FeNi is an example. Alloys with more than two starting components are also possible. Thus, for instance, alloys of the type FeSEB can be produced where SE=rare earths.

If one of the alloy components is a nondeformable powder, such as boron for a mixture of Fe and B powders, the B powder particles are incorporated between the Fe layers. In order to obtain a sufficiently fine structure, it is advantageous in this connection to start at the outset with a very fine B powder as the one alloying components, where the B-particles should be smaller than 1 μm. For thermodynamic reasons, it is advantageous here to use B-powder in the amorphous state.

The method according to the present invention will be further explained with the aid of the following example.

EXAMPLE

For manufacturing a metallic ribbon-shaped body of amorphous NiZr, the Ni powder and the Zr powder with powder particle sizes having an average size each of, for instance, 40 μm are placed in a powder mill (for example, trade name Fritsch, Type "Pulverisette-5") and are milled by means of steel balls, each of which has a diameter of 10 mm. Attention must be given to the fact that as a function of the milling time, initially the original particle size of the powders decreases but that later, larger particles are formed again. These particles grow with increasing milling time up to a maximum particle size with a diameter of about 20 to 100 μm. If these particles are observed in a cross-section, it is found that they then have an approximately stratified structure of the two materials Ni and Zr, and the respective layer thicknesses are less than 1 μm. These particles, therefore, form the desired mixture powder, so that the milling process is terminated at this time, because these particles of the mixture powder would be milled down again if the milling were continued, i.e., the stratified structure of the two alloying components required for the method according to the invention would be destroyed. Subsequently, steel tubes with an inside diameter of 15 mm and a wall thickness of 2.5 mm are filled with the mixture powder so obtained while the powder is being compacted, and are then closed off. The steel tubes with their cores of the mixture powder of the two alloying components are deformed by hammering to the desired dimensions of the ribbon to be produced. For instance, the core is brought down to a thickness of 1 mm. The so deformed and now ribbon-shaped structures are subsequently subjected to a diffusion annealing below the crystallization temperature of the desired amorphous materials for about 24 hours, for instance, at 300° C. If Co is used instead of Ni, the temperature to be chosen would be approximately 240° C. After the still present steel jacket is removed, for example, by etching with diluted hydrochloric acid, the desired ribbon of the amorphous alloy NiZr with the relatively large thickness of about 1 mm is present and can finally be processed further in a manner known per se.

According to the preceding example, it was assumed that the metallic body to be produced has an amorphous, i.e., noncrystalline structure, especially that of a metallic glass. The method according to the present invention can also be used to particular advantage for producing microcrystalline materials via the detour of the amorphous state. Thus, intermediate products of Nd-Fe-B alloys can accordingly be first prepared in amorphous form in accordance with the invention. In a subsequent annealing treatment, this alloy is then crystallized. The microcrystalline structure generated from the amorphous state has excellent hard-magnetic properties. See, for instance, *Applied Physics Letters,* Vol. 44, No. 1, January 1984, pages 148 and 149.

Although preferred embodiments of the present invention have been described in detail, it is contemplated that modifications will be made by those skilled in the art within the spirit and the scope of the present invention as defined in the claims.

What is claimed is:

1. In a method for manufacturing an amorphous metal alloy body including the steps of:

forming an intermediate product of at least a first alloy component and a second alloy component in powder form wherein each alloy component in the intermediate product has at least one dimension of at most about 1 μm in extent said forming step including a compacting step; and converting the intermediate product into a body having an amorphous metal alloy structure by a diffusion reaction at a predetermined elevated temperature;

the improvement comprising:

producing a mixture powder by milling a mixture of at least said first alloy component powder and said second alloy component powder and terminating the milling at a time so that the particles of the produced mixture powder are formed of predominately layer-like structures of said at least said first and second alloy components; and then effecting said compacting step by compacting and deforming the produced mixture powder to form the intermediate product having a predetermined shape.

2. A method according to claim 1 wherein said intermediate product is produced by a further deforming step.

3. A method according to claim 1 wherein the termination time of milling is determined by sectional examination of the particles of the produced mixture powder.

4. A method according to claim 1 wherein the milling takes place in a protective gas atmosphere.

5. A method according to claim 1 wherein the milling takes place at least at one predetermined temperature.

6. A method according to claim 1 wherein said predominantly layer-like structures each have a thickness of from about 0.01 μm to about 0.9 μm.

7. A method according to claim 6 wherein said predominantly layer-like structures each have a thickness of from about 0.05 μm to about 0.5 μm.

8. A method according to claim 6 wherein said particles of said produced mixture powder have diameters from about 10 μm to about 200 μm.

9. A method according to claim 7 wherein said particles of said produced mixture powder have diameters from about 20 μm to about 100 μm.

10. A method according to claim 1 wherein said produced mixture powder is deformed into said intermediate product by hammering.

11. A method according to claim 1 herein said produced mixture powder is deformed into said intermediate product by extrusion.

12. A method according to claim 1 wherein said diffusion reaction is performed after the completion of compacting.

13. A method according to claim 2 wherein said diffusion reaction is performed after the completion of deforming the intermediate product.

14. A method according to claim 1 wherein said diffusion reaction is performed simultaneously with compacting.

15. A method according to claim 2 wherein said diffusion reaction is performed simultaneously with deformation.

16. A method according to claim 1 wherein the amorphous metal alloy structure of the body is converted to a microcrystalline structure by an annealing treatment.

17. A method according to claim 2 wherein the amorphous metal alloy structure of the body converted to a microcrystalline structure by an annealing treatment.

18. A method according to claim 1 wherein said first and said second alloy components are both crystalline components.

19. A method according to claim 1 wherein at least one alloy component is a metal and at least another alloy component is a metalloid.

20. A method according to claim 19 wherein said metalloid alloy component is amorphous in structure.

21. A method according to claim 1 wherein at least one alloy component comprises an alloy of more than one element.

22. A method according to claim 1 wherein at least one alloy component comprises a compound of more than one element.

* * * * *